US007958590B2

(12) United States Patent
Trefethren et al.

(10) Patent No.: US 7,958,590 B2
(45) Date of Patent: Jun. 14, 2011

(54) CLEANING TOOL HANDLE FOR USE WITH A DISPOSABLE TOILET BRUSH

(75) Inventors: Susan M. Trefethren, Appleton, WI (US); Craig M. Thoms, Appleton, WI (US); Brian James Ludka, Neenah, WI (US); Maggie VanderHeiden Berger, Appleton, WI (US); Christopher James Uecker, Appleton, WI (US); Carl Gerard Rippl, Appleton, WI (US); Peter Laurence, Westlake Village, CA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 952 days.

(21) Appl. No.: 11/648,837

(22) Filed: Dec. 29, 2006

(65) Prior Publication Data

US 2008/0250590 A1 Oct. 16, 2008

(51) Int. Cl.
*A47K 11/10* (2006.01)

(52) U.S. Cl. ..... 15/147.1; 15/210.1; 294/8.5

(58) Field of Classification Search ..... 15/145, 15/150–152, 147.1, 177–178, 229.13, 210.1; 294/8.5, 13, 22, 31.1; 24/507, 521, 556, 24/541, 561–562, 564

See application file for complete search history.

(56) References Cited

U.S. PATENT DOCUMENTS

| | | | | | |
|---|---|---|---|---|---|
| 24,933 | A | * | 8/1859 | Greeley | 15/150 |
| 69,512 | A | * | 10/1867 | Troxel | 15/150 |
| 136,912 | A | * | 3/1873 | Haines | 15/150 |
| 1,631,791 | A | * | 6/1927 | Buckley | 15/167.1 |
| 2,079,709 | A | * | 5/1937 | Heider | 15/150 |
| 3,140,715 | A | * | 7/1964 | Whitton, Jr. et al. | 606/210 |
| 3,225,375 | A | | 12/1965 | Atkinson et al. | |
| 3,428,987 | A | | 2/1969 | Loston | |
| 3,983,596 | A | * | 10/1976 | Siemund | 15/244.1 |
| 4,031,673 | A | | 6/1977 | Hagelberg | |
| 4,493,124 | A | | 1/1985 | Agapiou | |
| 6,523,216 | B1 | | 2/2003 | Nelson | |

(Continued)

FOREIGN PATENT DOCUMENTS

| | | | |
|---|---|---|---|
| EP | 0 295505 | A2 | 6/1988 |
| GB | 2 362565 | A | 11/2001 |
| GB | 2 371474 | A | 7/2002 |

(Continued)

OTHER PUBLICATIONS

International Search Report and Written Opinion for Application No. PCT/IB2007/054719, completed Jun. 17, 2008, mailed Jun. 25, 2008, 11 pages.

*Primary Examiner* — Laura C Guidotti
(74) *Attorney, Agent, or Firm* — Dority & Manning, P.A.

(57) ABSTRACT

A cleaning tool is disclosed for cleaning adjacent surfaces. In one embodiment, for instance, the cleaning tool may be used as a toilet bowl brush. The cleaning tool includes a handle comprised of a first handle member pivotally attached to a second handle member. Each handle member terminates in a clamping plate. The clamping plates move towards and away from each other as the handle members are likewise moved towards and away from each other. The handle can include a locking member that engages the first handle member with the second handle member in order to clamp or hold a cleaning pad in between the clamping plates. The clamping plates can include raised wave-like protrusions that further assist in gripping a cleaning pad.

19 Claims, 5 Drawing Sheets

U.S. PATENT DOCUMENTS

| | | | |
|---|---|---|---|
| D502,002 | S | 2/2005 | Conway et al. |
| D511,873 | S | 11/2005 | Vitantonio et al. |
| 7,059,008 | B2 | 6/2006 | Morgan et al. |
| 2003/0135181 | A1 | 7/2003 | Chen et al. |
| 2005/0097694 | A1 | 5/2005 | Michaels et al. |
| 2005/0108843 | A1 | 5/2005 | Michaels et al. |
| 2005/0283931 | A1 | 12/2005 | Endo et al. |
| 2006/0225237 | A1 | 10/2006 | Gartland |

FOREIGN PATENT DOCUMENTS

| | | | |
|---|---|---|---|
| JP | 2001-46279 | * | 2/2001 |
| JP | 2005-152550 | * | 6/2005 |
| WO | WO 2005 006933 A | | 1/2005 |
| WO | 2005 046417 A1 | | 5/2005 |
| WO | 2005 046418 A1 | | 5/2005 |
| WO | WO 2006 005925 A | | 1/2006 |

* cited by examiner

CLEANING TOOL HANDLE FOR USE WITH A DISPOSABLE TOILET BRUSH

BACKGROUND

Conventional toilet bowl brushes typically consist of a handle attached to a plurality of bristles. The bristles are typically made from a synthetic material that is capable of scrubbing the toilet bowl without scratching the bowl. Conventional toilet bowl brushes are designed to be used repeatedly over an extended length of time.

After repeated uses, however, toilet bowl brushes tend to discolor and tend to collect debris and other waste materials from the toilet bowl environment. In addition, toilet bowl brushes are typically placed back into a receptacle after use while still wet with toilet bowl water. This water can drip off the brush and soil the receptacle. As a result, toilet bowl brushes and their receptacles can develop an unpleasant appearance and even an unpleasant odor after multiple uses.

In view of the above, those skilled in the art have developed various toilet bowl brush handles that are to be used with disposable and replaceable brush heads. In these embodiments, only the brush handle is to be used repeatedly. The brush head, on the other hand, is to be disposed of after only one use. Such devices are disclosed, for instance, in U.S. Pat. No. 7,059,008, in U.S. Patent Application Publication No. US2005/0108843 and in U.S. Patent Application Publication No. US 2006/0225237, which are all incorporated herein by reference.

The above identified publications disclose various handle configurations and various disposable brush head configurations. A need, however, still remains for a handle capable of engaging a disposable cleaning head that is not only relatively simple to manufacture and easy to use, but also exhibits sufficient clamping force to hold a disposable brush head.

SUMMARY

The present disclosure is directed to an improved cleaning tool handle and to a cleaning tool that is particularly well suited to being used as a toilet bowl brush. The cleaning tool, however, may be used in other applications.

In one embodiment, for instance, the cleaning tool of the present disclosure comprises a cleaning tool handle for engaging a cleaning instrument. The cleaning tool handle includes a first handle member pivotally connected about a hinge to a second handle member. The first and second handle members are cooperatively engaged with each other to form the handle. Each handle member includes a first end and a second and opposite end. The second end of the first handle member includes a first clamping plate and the second end of the second handle member includes a second clamping plate.

In one embodiment, a locking member may extend from the first handle member and into an opening defined by the second handle member. The locking member may define at least one locking element that is configured to engage the second handle member when the first end of the first handle member is brought together with the first end of the second handle member. Forcing the first end of the first handle member together with the first end of the second handle member also causes the clamping plates to move together for holding a cleaning instrument, such as a cleaning pad. The locking member may be moveable for disengaging the locking element from the second handle member thereby releasing any cleaning instrument held by the clamping plates.

In one embodiment, the first handle member may be shorter in length than the second handle member. For instance, the first end of the second handle member may define a gripping section configured to be held by a user when the cleaning tool handle is used to clean an adjacent surface. The first handle member, on the other hand, may terminate below the gripping section adjacent to where the locking member is located.

In one embodiment, the locking member may extend all the way through the second handle member and protrude through the bottom of the handle having a trigger-like appearance. The locking member can include a plurality of locking elements positioned sequentially along the length of the locking member. The plurality of locking elements may be provided for adjusting the amount the clamping plates are spaced apart when engaging a cleaning instrument. The locking elements, for instance, may have a triangular shape with a flat ledge that is configured to engage the opposing handle member.

The first and second clamping plates may be integral with the respective handle members or may be separate components that are attached to the handle members. As described above, the first handle member is pivotally connected to the second handle member. For example, in one embodiment, one of the handle members may include a pivot element that is configured to be inserted into an opening defined by the other handle member.

In one embodiment, the cleaning tool handle is made exclusively from the first handle member and the second handle member. The cleaning tool handle can be made from any suitable material, such as a plastic material. Of particular advantage, the clamping plates, when brought together, are capable of exerting at least about 25 psi of pressure against a cleaning instrument positioned in between the clamping plates.

In one embodiment, one clamping plate or both clamping plates may include protrusions that assist in gripping a cleaning instrument held in between the plates. For instance, the protrusions may comprise at least one wave-like element that is substantially perpendicular to the lengthwise direction of the handle. The clamping plates may each include a plurality of rows of the wave-like elements. The height of the rows can descend from a front edge of the clamping plates to a back edge. The wave-like rows of protrusions can also slightly angle towards the back edge of the clamping plates.

The cleaning tool handle can have an overall S-like shape. For instance, the handle can include a first curve in a first direction and a second curve in a second and opposite direction. For instance, the handle can have a S-like shape such that when the handle is being held by a user, the clamping plates are generally pointed in an upwards direction.

The cleaning tool handle of the present disclosure can be used to hold generally any suitable cleaning instrument. In one embodiment, for instance, the cleaning tool handle can be configured to hold a disposable cleaning pad. The cleaning pad, for instance, can be made from a stack of nonwoven webs formed from pulp fibers. When used to clean toilet bowls, for instance, the nonwoven webs can be water degradable so that the entire pad can be flushed down the toilet after use.

Other features and aspects of the present disclosure are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figure in which.

Repeat use of references characters in the present specification and drawing is intended to represent same or analogous features or elements of the invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a cleaning tool that can be used to clean any suitable adjacent surface. In one embodiment, for instance, the cleaning tool can be configured to be used as a toilet bowl brush. The cleaning tool generally includes a handle that has a gripping section at one end and a pair of clamping plates at the opposing end. The clamping plates are moveable towards and away from each other for releasably engaging a cleaning instrument, such as a cleaning pad.

In one embodiment, for instance, the handle can be used to grip a disposable cleaning pad. After one or more uses, for instance, the cleaning pad can be disposed of and replaced on the handle. When the cleaning tool is used as a toilet bowl brush, for instance, the disposable cleaning pad may be made from water dispersible materials. In this manner, the cleaning pad can be flushed down the toilet bowl after the toilet bowl has been cleaned.

Figure 1:
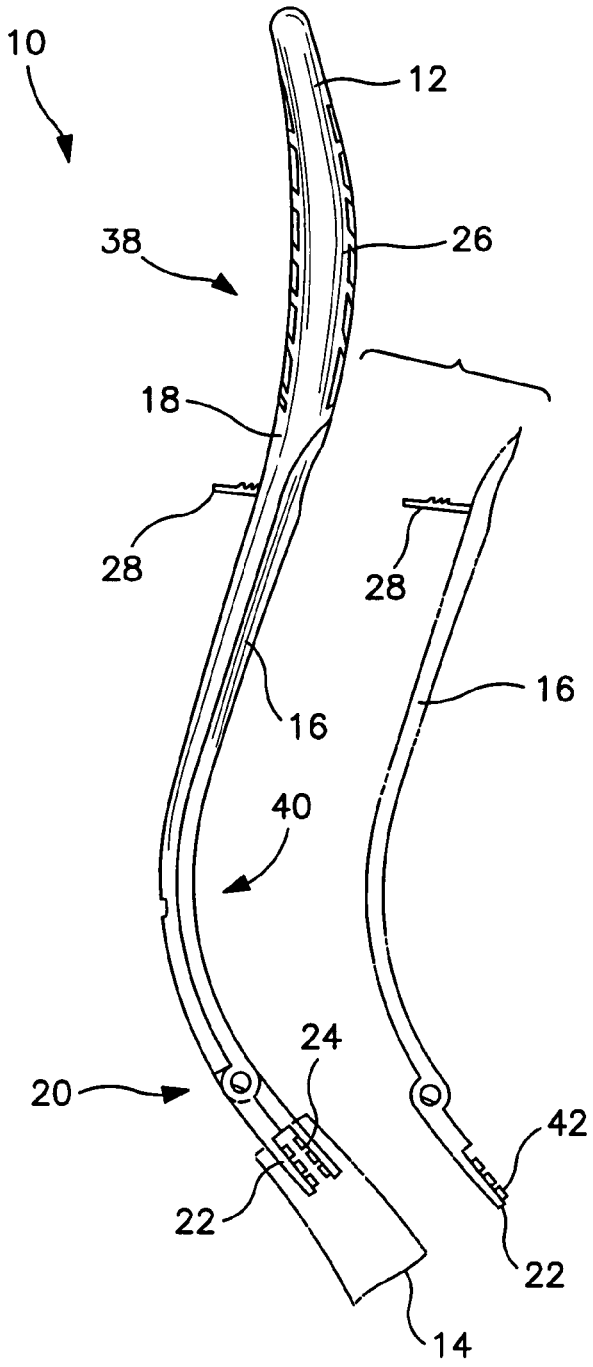
FIG. 1 is a side view of one embodiment of a cleaning tool made in accordance with the present disclosure.
Figure 2:
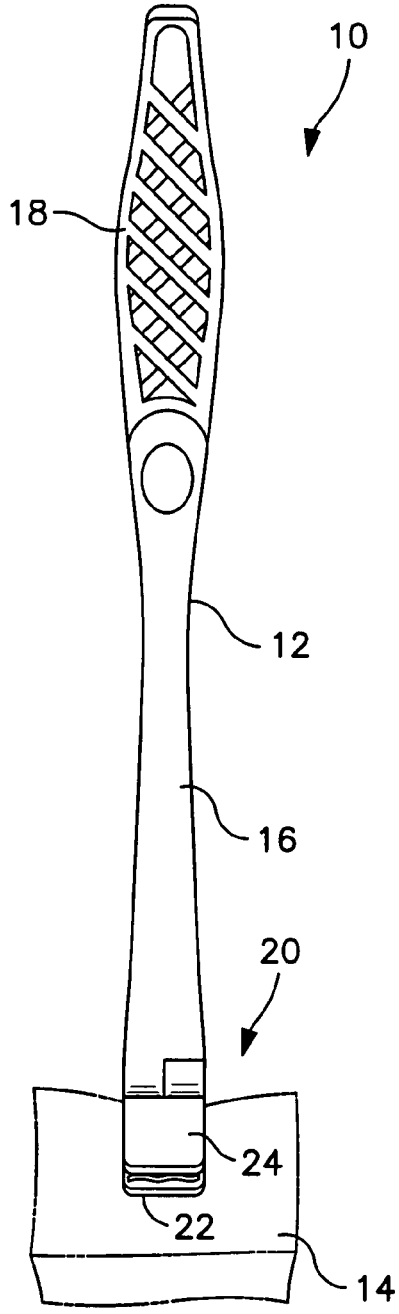
FIG. 2 is a top plan view of the cleaning tool illustrated in FIG. 1.

Referring to FIGS. 1 and 2, one embodiment of a cleaning tool 10 made in accordance with the present disclosure is illustrated. As shown, the cleaning tool 10 includes a handle 12 that can be used to hold and grip a cleaning pad 14 for cleaning adjacent surfaces. Of particular advantage, the handle 12, in one embodiment, can have a two-piece design made from a first handle member 16 (also shown separate in phantom in FIG. 1) attached to a second handle member 18. For example, the first handle member 16 can be pivotally connected to the second handle member 18 about a hinge 20.

As illustrated in FIGS. 1 and 2, each handle member 16 and 18 terminates with a clamping plate. For instance, handle member 16 includes a first clamping plate 22, while second handle member 18 includes a second clamping plate 24. The clamping plates 22 and 24 are positioned opposite one another and are configured to grasp and hold the cleaning pad 14. The handle members 16 and 18 can be the same length or can have different lengths. In the embodiment illustrated in FIGS. 1 and 2, for instance, the first handle member 16 is shorter in length than the second handle member 18. In this regard, the second handle member 18 defines a gripping section 26 that is designed to be held by a user when the cleaning tool 10 is used to clean an adjacent surface. It should be understood, however, that in other embodiments, the first handle member 16 may generally have the same length as the second handle member 18. In this embodiment, both handle members may cooperatively form the gripping section 26.

In order to move the clamping plates 22 and 24 towards and away from each other, the first handle member 16 is moveable towards and away from the second handle member 18. For instance, in order to separate the clamping plates 22 and 24 for inserting or releasing a cleaning pad 14, the first handle member 16 may be moved away from the second handle member 18 about the hinge 20. In order for the clamping plates to move together and clamp the cleaning pad 14, on the other hand, the first handle member 16 can be brought together with the second handle member 18.

Figure 5:
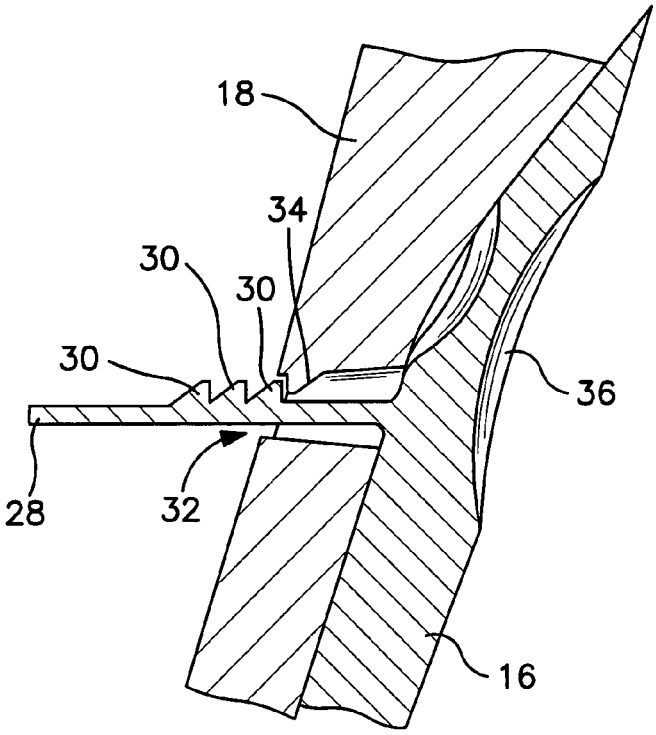
FIG. 5 is a side view with cutaway portions of a locking member that may be used to lock two clamping plates in position when holding a cleaning pad in accordance with the present disclosure.

In order to lock the clamping plates 22 and 24 into an engagement position with a cleaning pad 14, the cleaning tool 10 can include a locking member 28. The locking member 28 is more particularly illustrated in FIG. 5. As shown, the locking member 28 is inserted into an opening 32 defined by the second handle member 18. In the embodiment illustrated, for instance, the locking member 28 extends all the way through the second handle member 18 and protrudes from the bottom of the handle 12. In this manner, the locking member 28 has a trigger-like appearance as shown in FIG. 1. As illustrated in FIG. 5, the locking member 28 can be integral with the first handle member 16.

In order for the first handle member 16 to engage the second handle member 18 for locking the clamping plates 22 and 24 into position, the locking member 28 can include at least one locking element 30. For example, as shown in FIG. 5, the locking member 28 includes three sequential locking elements 30. The locking elements 30 can have any suitable shape that is capable of engaging the second handle member 18. In the embodiment illustrated, for instance, the locking elements 30 have a triangular shape defining a flat ledge that is configured to engage a corresponding protrusion 34 that is formed into the opening 32. The protrusion 34 and the locking element 30 matingly engage each other when the locking member 28 is inserted through the opening 32 by forcing the first handle member 16 together with the second handle member 18.

The locking member 28 can include a plurality of locking elements 30 in order to adjust the amount of pressure the clamping plates 22 and 24 apply to the cleaning pad 14. For instance, inserting the locking member 28 as far as possible through the opening 32 creates the most clamping force by the clamping plates 22 and 24. By including multiple locking elements 30 as shown in FIG. 5, the amount of clamping force placed against the cleaning pad can be adjusted. In this manner, the clamping plates 22 and 24 can be configured to accommodate cleaning pads having different sizes.

In order to release a cleaning pad 14 from the clamping plates 22 and 24, the locking member 28 can be disengaged from the second handle member 18. For example, as shown in FIG. 5, the locking member 28 can be moved within the opening 32 causing the locking elements 30 to disengage from the protrusion 34.

In order to facilitate bringing together the first handle member 16 and the second handle member 18, the handle members can have any suitable shape. In the embodiment illustrated in FIGS. 1, 2 and 5, for instance, the first handle member 16 defines a depression 36. The depression 36, for instance, can have an ovular shape that has a size suitable to accommodate the thumb of a user. For instance, when a user is engaging the locking member by bringing together the first handle member 16 and the second handle member 18, a user can hold the gripping section 18 and force the locking member through the opening 32 by applying thumb pressure to the depression 36.

In the embodiment illustrated in FIG. 1, the locking member 28 extends from the first handle member 16 through an opening defined by the second handle member 18. In an alternative embodiment, however, the locking member 28 may extend from the second handle member 18 and protrude through the top of the handle.

Of particular advantage, the relatively simple handle design of the cleaning tool 10 has been found to create a relatively large amount of clamping pressure between the clamping plates 22 and 24. For instance, when the locking member 28 is engaged with the second handle member 18, the clamping plates 22 and 24 can exert greater than about 25 psi of pressure to the cleaning pad 14. For example, in one embodiment, the clamping plates may apply even greater than about 30 psi of pressure to the cleaning pad 14. In this manner, the cleaning pad is secured into place even during rigorous cleaning motions.

Referring to FIG. 1, in one embodiment, especially when used as a toilet bowl brush, the handle 12 can have a S-like shape. In particular, the handle 12 can define a first curvature 38 and a second and opposite curvature 40. In this manner, when the cleaning tool 10 is being held by a user at the gripping section 26, the clamping plates 22 and 24 generally point in an upwards direction. Having the cleaning pad 14 point in an upwards direction allows a user to easily clean below the rim of a toilet bowl without having to excessively stoop or kneel. As shown in FIG. 1, for instance, the second curvature 40 can be greater than the first curvature 38. For instance, the second curvature 40 can have an arc length of from about 15° to about 35°.

Figure 3A:
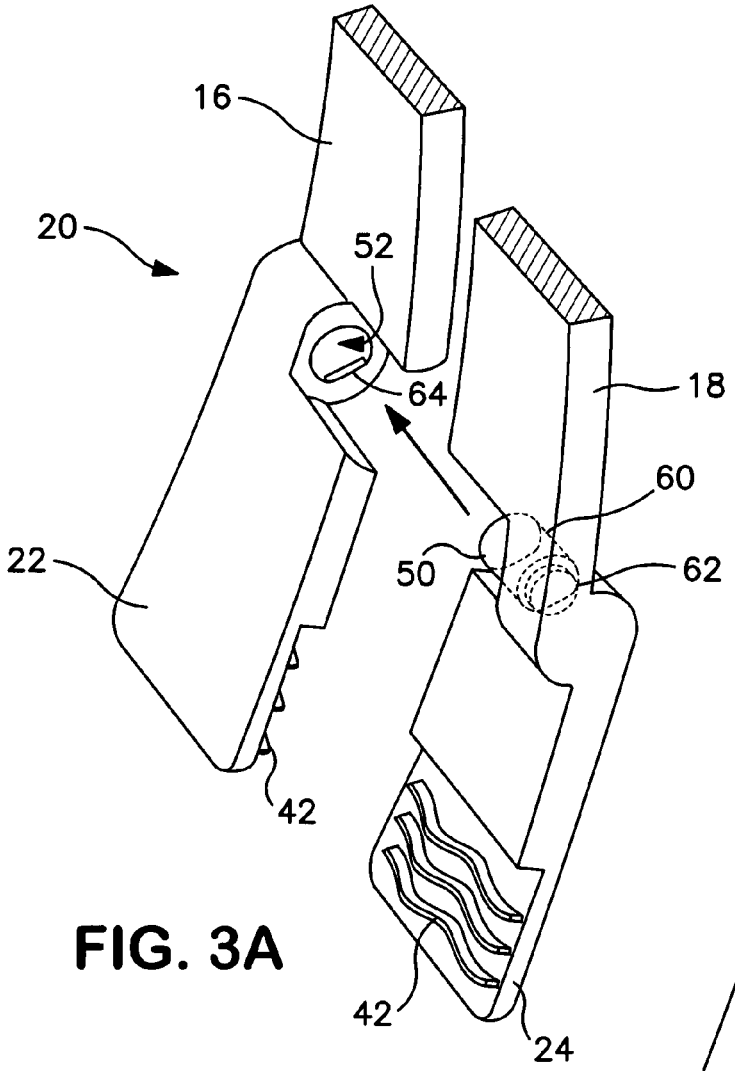
FIGS. 3A through 3D are perspective views with cutaway portions of one embodiment of a hinge that may be incorporated into the cleaning tool handle of the present disclosure.
Figure 3B:
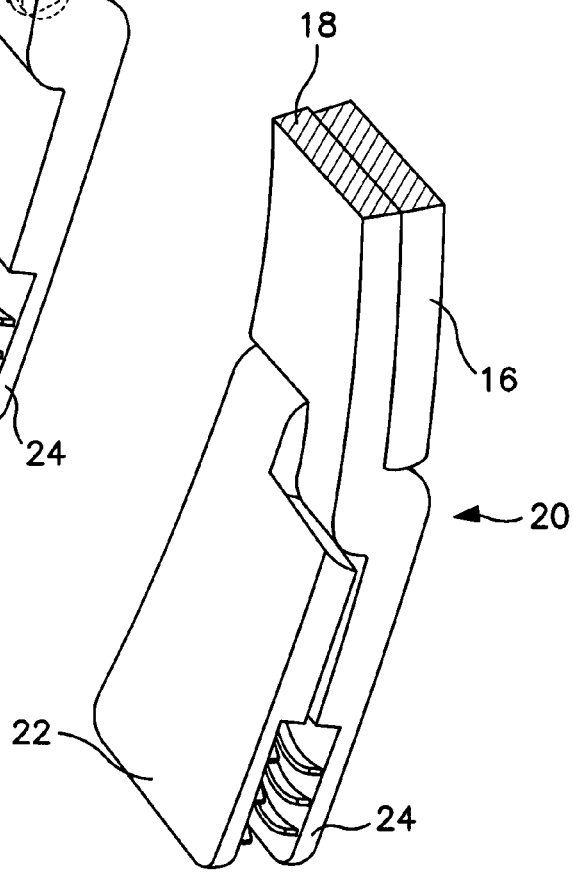

Referring to FIGS. 3A through 3D, a more detailed illustration of the hinge 20 that can be used to pivotally attach the first handle member 16 to the second handle member 18 is shown. As illustrated, the second handle member 18 defines a pivot element 50, while the first handle member 16 defines a corresponding opening 52. It should be understood, however, that the opening and pivot element may be reversed. For instance, the pivot element 50 may be positioned on the first handle member 16, while the opening may be defined by the second handle member 18. As shown in FIG. 3B, the pivot element 50 is inserted into the opening 52 for attaching the first handle member 16 to the second handle member 18.

If desired, the pivot element 50 may have an interlocking relationship with the opening 52 in order to prevent the handle members from coming apart. For instance, as shown in FIGS. 3A through 3D, the pivot element 50 can have a first section 60 and a second section 62. The second section 62 may have a diameter that is less than the diameter of the first section 60. As shown, the first section 60 also includes a flat portion.

Figure 3C:
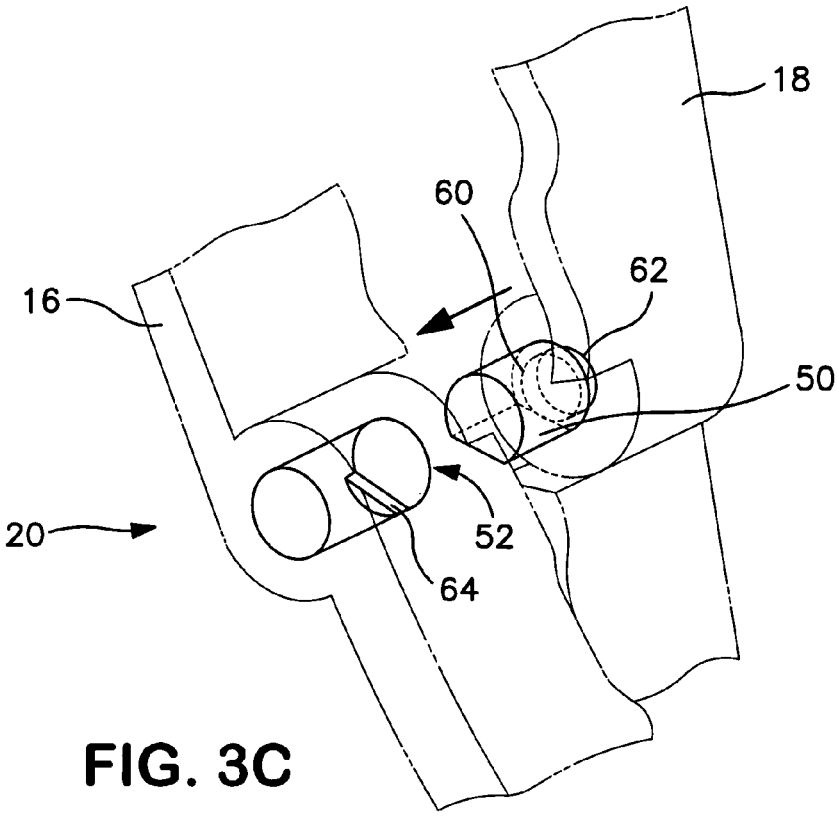
Figure 3D:
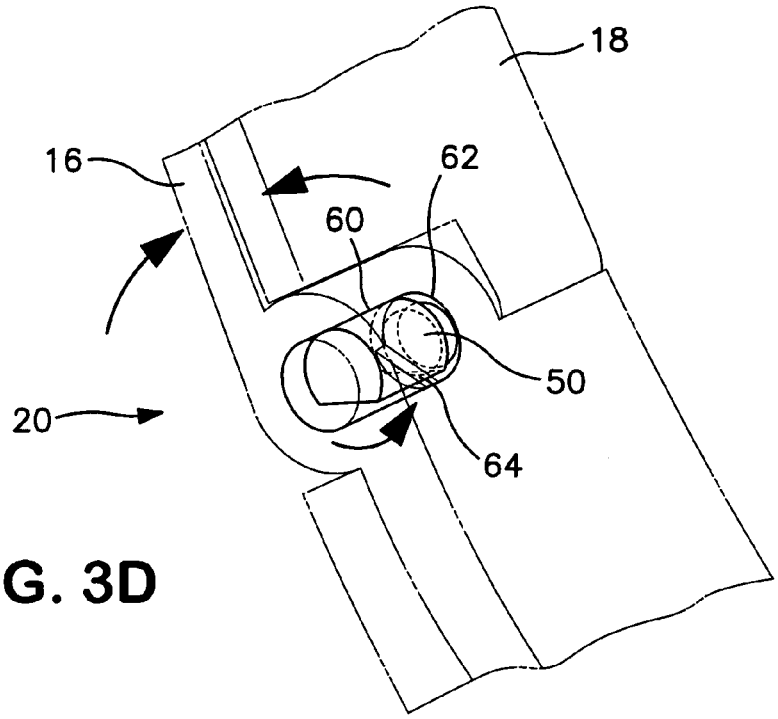

The opening 52, on the other hand, can include a retaining member 64 which, in this embodiment, has a wedge-like shape. The retaining member 64 forms a circumference at the beginning of the opening 52 that generally corresponds to the shape of the first section 60 of the pivot element 50. As shown in FIGS. 3C and 3D, in order to attach the first handle member 16 to the second handle member 18, the shape of the first section 60 of the pivot element 50 is first aligned with the shape of the opening 52 at the entrance to the opening. The pivot element 50 is then inserted into the opening 52 until the retaining element 64 is aligned with the second section 62 of the pivot element 50. As shown in FIG. 3D, once the handle members are then rotated, the retaining member 64 prevents the pivot element 50 from exiting the opening 52. Thus, the retaining element 64 maintains the pivot element 50 in place while still allowing the pivot element 50 to rotate as the handle members are rotated.

As shown in FIG. 3B, when the pivot element 50 is engaged within the opening 52, the handle members are in a crisscross relationship. In this manner, the clamping plates are capable of coming together when the handle members are brought together. As also shown in the figures, the hinge 20 can be located a certain distance from the clamping plates 22 and 24. In particular, the hinge 20 can be positioned along the length of the handle for increasing or decreasing the amount of leverage that is exerted when the handle members are brought together.

As shown in FIGS. 1, 2, 3A and 3B, the clamping plates 22 and 24 can include protrusions 42 that assist in gripping and holding a cleaning pad 14. In general, the protrusions 42 may have any suitable shape. For instance, the protrusions can comprise discrete shapes such as pins or may have bar-like shapes.

In one particular embodiment, as shown in FIG. 3A, the protrusions 42 may comprise a plurality of rows of wave-like elements. Each protrusion 42, for instance, may be in the shape of a sine wave. As also shown, the rows of wave-like elements can be positioned on the clamping plates so as to be substantially perpendicular to the lengthwise direction of the handle 12.

The present inventors have discovered that the wave-like protrusions are particularly well suited to gripping and holding a compressible cleaning pad. For instance, the wave-like protrusions not only prevent the cleaning pad from moving in the lengthwise direction but also are well suited to preventing the cleaning pad from moving in the widthwise direction. In particular, the wave-like shape of the protrusions provides resistance to movement not only in the lengthwise direction but also in the side-to-side direction. The amplitude of the sine waves can be adjusted for the particular application in order to resist movement in the widthwise direction. For instance, a greater amplitude will better secure the cleaning pad in a direction perpendicular to the lengthwise direction of the handle.

Figure 6:
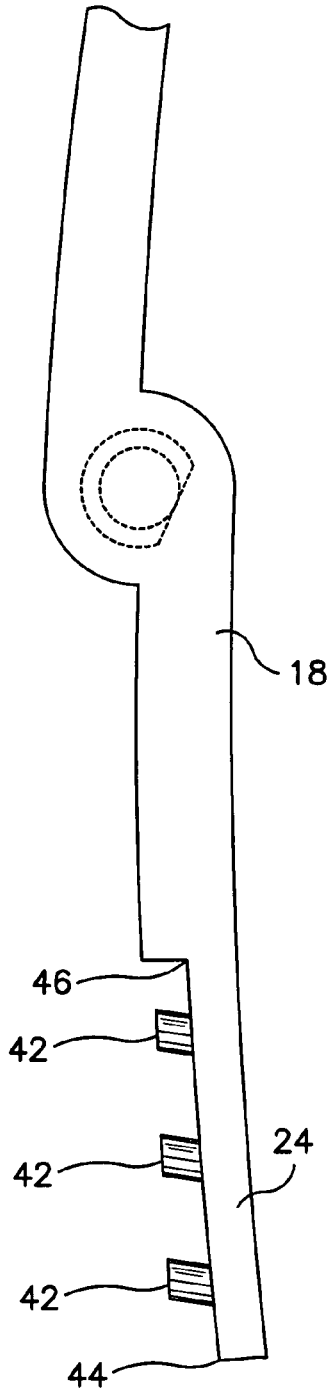
FIG. 6 is a side view of one embodiment of a clamping plate that may be incorporated into the cleaning tool handle of the present disclosure.

Referring to FIG. 6, a cross section of the wave-like protrusions 42 is shown as appearing on the clamping plate 24. As illustrated, in addition to having a wave-like shape, the protrusions 42 can also be slightly angled or slanted in order to further improve the gripping properties of the clamping plates. For example, as shown, the clamping plate 24 can include a front edge 44 and a back edge 46. The front edge 44, for instance, forms the outermost edge of the handle 12. As shown, the protrusions 42 can be slightly angled towards the back edge 46. In particular, the protrusions 42 can be angled from about 1° to about 5°. For instance, in one particular embodiment, the protrusions 42 may angle approximately 2½° towards the back edge 46. In the embodiment illustrated in FIG. 6, each row of protrusions 42 is angled towards the back edge. It should be understood, however, that in other embodiments only certain of the rows can be angled towards the back edge.

In addition to being slightly angled, the protrusions 42 can also have varying heights. For instance, the protrusions may descend in height from the front edge 44 to the back edge 46. In one embodiment, for instance, the row of protrusions nearest the front edge may have a height of about 3/32 inches, while the last row of protrusions 42 nearest the back edge 46 may have a height of about 5/64 inches. The above dimensions, however, are only provided for exemplary purposes. The height of the protrusions may vary significantly depending upon the particular application and the type of cleaning pad that is to be held between the clamping plates.

In the embodiments illustrated in the figures, each clamping plate contains three rows of protrusions. The rows of protrusions on one clamping plate generally correspond to the rows of protrusions on the opposing clamping plate. It should be understood, however, that each clamping plate may include a greater or lesser number of rows. Also, the rows may be offset with respect to one another depending upon the particular application.

Figure 4A:
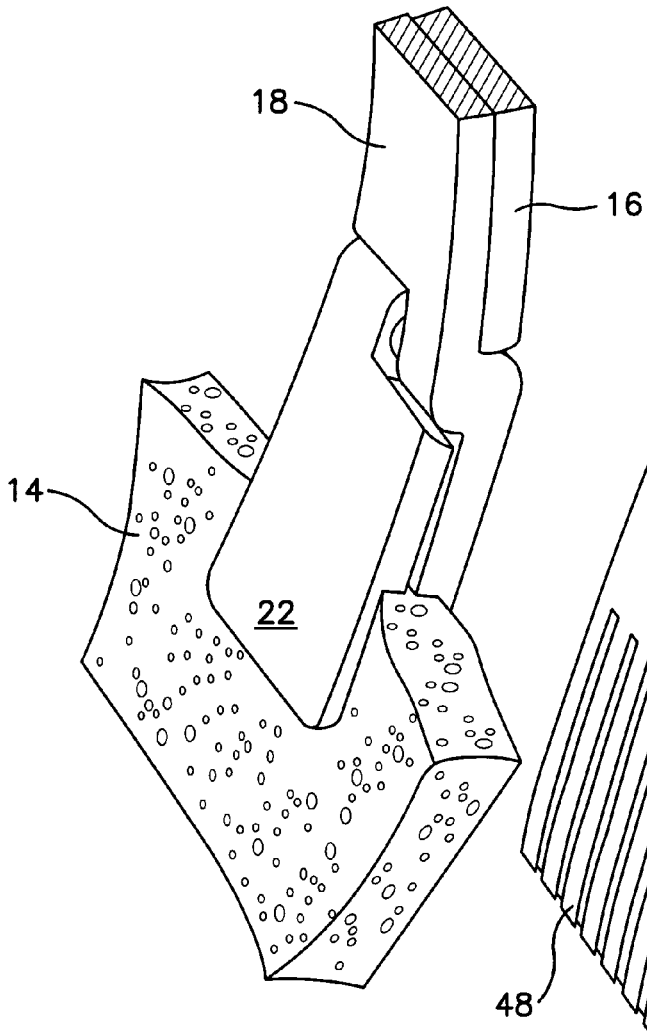
FIG. 4A is a perspective view with cutaway portions of one embodiment of a cleaning head that may be used with the cleaning tool handle of the present disclosure.

The handle 12 of the present disclosure can be used to hold and grasp any suitable cleaning instrument. Although the cleaning tool 10 is particular well suited for use as a toilet bowl brush, it should be understood that the cleaning tool can be used in numerous applications. In one embodiment, for instance, as shown in FIG. 4A, the handle 12 may be configured to hold a sponge-like cleaning pad 14. The cleaning pad 14 as shown in FIG. 4A may be comprised entirely of a liquid absorbent material or may contain a strip of abrasive material for assisting in scrubbing an adjacent surface.

Figure 4B:
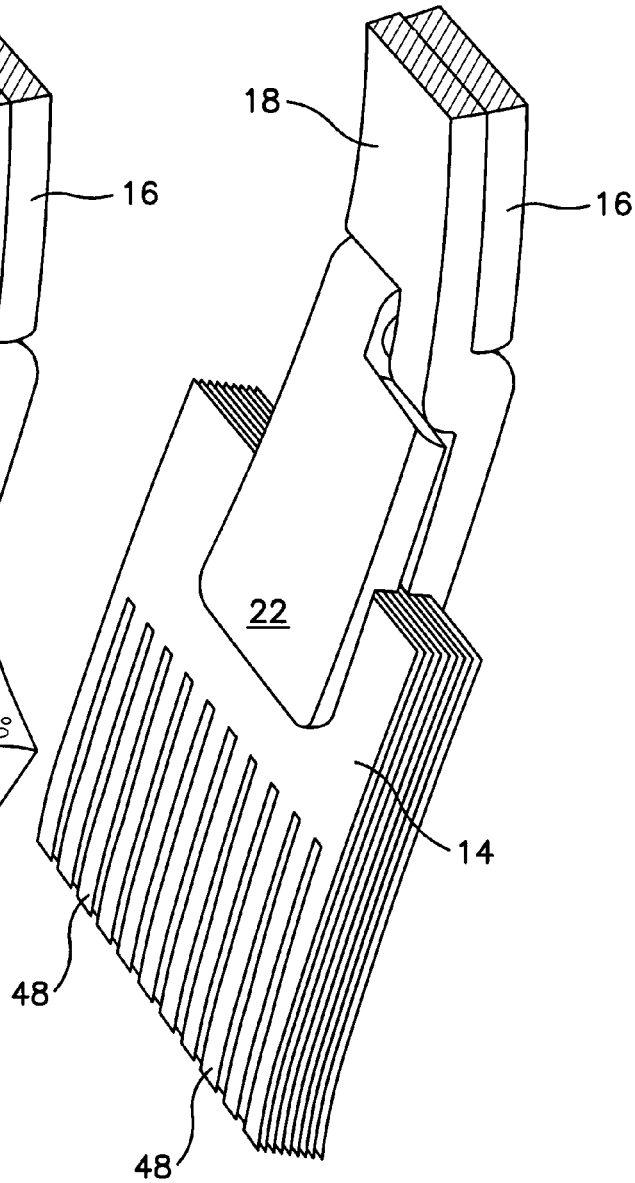
FIG. 4B is a perspective view with cutaway portions of an alternative embodiment of a cleaning head that may be used with the cleaning tool handle of the present disclosure.

In an alternative embodiment, as shown in FIG. 4B, the cleaning pad 14 may be comprised of a stack of nonwoven webs. The nonwoven webs, for instance, can be made from pulp fibers. Each nonwoven web can be made according to any suitable process. For instance, the nonwoven webs can comprise wetlaid webs, airformed webs, or mixtures thereof. Wetlaid webs are made by depositing an aqueous slurry of fibers onto a moving wire to form an embryonic web which is subsequently dewatered and dried. Drying operations can include drum drying, throughdrying, steam drying, displacement dewatering, Yankee drying, infrared drying, microwave drying, radio frequency drying, impulse drying, and mixtures thereof. The tissue webs can be creped or uncreped.

Airformed webs, on the other hand, are generally formed by entraining fluff pulp fibers in an air stream that is then deposited upon a moving fabric.

As shown in FIG. 4B, in one embodiment, the stack of nonwoven webs can be slit at one end forming scrubbing members 48. For instance, in one embodiment, the stack of webs can be connected together at one end opposite the scrubbing members.

When the cleaning pad 14 is formed from a stack of nonwoven webs, the cleaning pad is disposable and can be disposed of after a single use or after two or three uses. In one embodiment, the cleaning pad 14 can be made from nonwoven webs that are water dispersible. Thus, when used to clean a toilet bowl, the webs will degrade as the cleaning process proceeds. After the toilet bowl is cleaned, the cleaning pad can be removed from the handle 12 and flushed down the toilet with the cleaning solutions.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A cleaning tool handle for engaging a cleaning instrument comprising:

a first handle member pivotally connected about a hinge to a second handle member, the first and second handle members cooperatively engaging with each other to form the handle, each handle member including a first end and a second and opposite end, the second end of the first handle member including a first clamping plate and the second end of the second handle member including a second clamping plate;

a locking member extending from the first handle member and into an opening defined by the second handle member, the locking member defining at least one locking element that is configured to engage the second handle member when the first end of the first handle member is brought together with the first end of the second handle member, forcing the first end of the first handle member together with the first end of the second handle member also causing the clamping plates to move together for holding a cleaning instrument, the locking member being moveable for disengaging the locking element from the second handle member;

wherein the first clamping plate defines a first surface that faces the second clamping plate and the second clamping plate defines a first surface that faces the first clamping plate, the first surface of the first clamping plate and the first surface of the second clamping plate including protrusions that assist in gripping a cleaning instrument; and wherein the protrusions comprise rows of wave-like elements, the handle defining a lengthwise direction, the rows of wave-like elements being substantially perpendicular to the lengthwise direction of the handle, the clamping plates each including a front edge and a back edge, the front edge comprising the outer most edge of the second end of each respective handle member, and wherein the rows of wave-like elements having a descending height from the front edge to the back edge.

2. A cleaning tool handle as defined in claim 1, wherein the first handle member is shorter in length than the second handle member, the first end of the second handle member defining a gripping section configured to be held by a user when the cleaning tool handle is used to clean an adjacent surface.

3. A cleaning tool handle as defined in claim 1, wherein the hinge comprises a pivot element extending from one of the handle members and being inserted into an opening defined by the other handle member.

4. A cleaning tool handle as defined in claim 3, wherein the hinge includes a retaining member that prevents the first handle member from separating from the second handle member.

5. A cleaning tool handle as defined in claim 1, wherein the clamping plates are configured to exert at least 25 psi of pressure against a cleaning instrument when the first surface of the first clamping plate and the first surface of the second clamping plate are positioned adjacent to the cleaning instrument and the locking element is engaged with the second handle member.

6. A cleaning tool handle as defined in claim 1, wherein the first clamping plate is integral with the first handle member and the second clamping plate is integral with the second handle member.

7. A cleaning tool handle as defined in claim 1, wherein the locking member includes a plurality of locking elements positioned sequentially along the locking member for adjusting the amount the clamping plates are spaced apart when the locking member is engaged with the second handle member.

8. A cleaning tool handle as defined in claim 1, wherein the locking element has a triangular shape with a flat ledge that is configured to engage the second handle member.

9. A cleaning tool handle as defined in claim 1, wherein the handle has a S-shape including a first curve in a first direction and a second curve in a second and opposite direction, the handle having a S-shape such that, when the handle is being held by a user, the clamping plates are generally pointed in an upwards direction.

10. A cleaning tool handle as defined in claim 1, wherein the entire handle is made from a plastic material.

11. A cleaning tool comprising:

a first handle member connected to a second handle member, each handle member including a first end and a second and opposite end, the second end of the first handle member including a first clamping plate and the second end of the second handle member including a second clamping plate, the clamping plates being moveable towards and away from each other, the first clamping plate defining a first surface facing the second clamping plate and the second clamping plate defining a first surface facing the first clamping plate, and wherein the first surface of the first clamping plate and the first surface of the second clamping plate each define a plurality of rows of wave-like protrusions, the first and second handle members defining a lengthwise direction, the plurality of rows of wave-like protrusions being substantially perpendicular to the lengthwise direction of the handle members wherein the rows of wave-like protrusions are angled towards the first end of each respective handle member; and a cleaning pad that is releasably clamped in between the first clamping plate and the second clamping plate.

12. A cleaning tool as defined in claim 11, wherein each clamping plate includes at least three rows of wave-like protrusions.

13. A cleaning tool as defined in claim 11, wherein each clamping plate includes a front edge and a back edge, the front edge comprising the outer most edge of the second end of each respective handle member, the rows of wave-like protrusions having a descending height on each clamping plate from the front edge to the back edge.

14. A cleaning tool as defined in claim 11, wherein each clamping plate includes a front edge and a back edge, the front edge comprising the outer most edge of the second end of each respective handle member, the rows of wave-like protrusions having a descending height on each clamping plate from the front edge to the back edge.

15. A cleaning tool as defined in claim 11, wherein the handle has an S-shape including a first curve in a first direction and a second curve in a second and opposite direction, the handle having a S-shape such that, when the handle is being held by a user, the clamping plates are generally pointed in an upwards direction.

16. A cleaning tool as defined in claim 11, wherein the first handle member is pivotally connected about a hinge to the second handle member and wherein the cleaning tool further comprises a locking member extending from the first handle member and into an opening defined by the second handle member, the locking member defining at least one locking element that, is configured to engage the second handle member when the first end of the first handle member is brought together with the first end of the second handle member, forcing the first end of the first handle member together with the first end of the second handle member also causing the clamping plates to move together for holding the cleaning pad therebetween, the locking member being moveable for disengaging the locking element from the second handle member and releasing the cleaning pad.

17. A cleaning tool as defined in claim 16, wherein the first handle member is shorter in length than the second handle member, the first end of the second handle member defining a gripping section configured to be held by a user when the cleaning tool handle is used to clean an adjacent surface.

18. A cleaning tool as defined in claim 11, wherein the cleaning pad comprises a stack of nonwoven webs containing pulp fibers.

19. A cleaning tool as defined in claim 18, wherein the nonwoven webs are water degradable.

* * * * *